US005598138A

United States Patent [19]

Jaronczyk, Jr.

[11] Patent Number: 5,598,138

[45] Date of Patent: Jan. 28, 1997

[54] FAULT-INDICATING BLADE FUSE

[76] Inventor: Joseph P. Jaronczyk, Jr., 21 Pine Dr., Windsor, Conn. 06095

[21] Appl. No.: 368,303

[22] Filed: Jan. 3, 1995

[51] Int. Cl.[6] ..... H01H 85/30

[52] U.S. Cl. ..... 337/265; 337/198

[58] Field of Search ..... 337/198, 206, 337/264, 265, 266, 255

[56] References Cited

U.S. PATENT DOCUMENTS

| | | | |
|---|---|---|---|
| 2,471,848 | 3/1949 | Von Hoorn | 200/114 |
| 2,610,237 | 9/1952 | Benner | 177/311 |
| 2,623,099 | 12/1952 | Wallace | 175/183 |
| 2,735,088 | 2/1956 | Kinzer | 340/250 |
| 3,107,350 | 10/1963 | Arrasmith | 340/381 |
| 3,218,413 | 11/1965 | Koch | 337/206 |
| 3,436,711 | 4/1969 | Borzoni | 337/198 |
| 3,498,131 | 3/1970 | Rickey | 73/304 |
| 3,548,399 | 12/1970 | Monigal et al. | 340/253 |
| 3,717,117 | 2/1973 | Stanley | 116/128 |
| 3,889,248 | 6/1975 | Ritter | 340/249 |
| 3,896,423 | 7/1975 | Lindberg | 340/229 |
| 4,001,804 | 1/1977 | Irving | 340/255 |
| 4,382,225 | 5/1983 | Peltz | 324/73 R |
| 4,387,358 | 6/1983 | Knapp, Jr. | 337/244 |
| 4,604,602 | 8/1986 | Borzoni | 337/198 |
| 4,691,197 | 9/1987 | Damiano et al. | 340/638 |
| 5,300,913 | 4/1994 | Linton | 337/242 |

*Primary Examiner*—Lincoln Donovan
*Attorney, Agent, or Firm*—Ira S. Dorman

[57] ABSTRACT

A fault-indicating blade fuse includes a light-emitting electrical device that is positioned for ready visibility from above the fuse. The device lies within the bounds of the upper body profile of the fuse, and is so constructed and connected as to be activated upon fusion of the link, when the fuse is subjected to excessive current. In one form, a supplemental component contains a light-emitting electrical device and includes means for affixing it to the upper body portion of a fuse. Contact elements on the supplemental component establish electrical contact with the blades of the assembled fuse.

17 Claims, 3 Drawing Sheets

FAULT-INDICATING BLADE FUSE

BACKGROUND OF THE INVENTION

So-called "blade fuses" have now substantially replaced the tubular glass fuses that were once standard in the automotive industry. A disadvantageous feature of such blade fuses is however that, when installed in a fuse block, the fusible element or link is hidden from view. Locating a blown fuse therefore normally entails withdrawal of the fuses from the block, one-by-one until the defective fuse is found.

SUMMARY OF THE INVENTION

Accordingly, it is the broad object of the present invention to provide a novel blade fuse having an integrated fault-indicating feature.

A more specific object of the invention is to provide such a fuse in which the fault is indicated by illumination of a light-emitting electrical device.

Another specific object is to provide a supplemental component for assembly with a conventional blade fuse to render it fault-indicating.

It has now been found that certain of the foregoing and related objects of the invention are readily attained by the provision of a blade fuse having a relatively thin and flat, generally rectangular body fabricated from a dielectric material and of typical configuration; i.e., the body is defined by top, bottom and opposite side margins, and its upper portion has a long, narrow profile, as viewed in transverse cross section. A pair of generally parallel metal blades project downwardly beyond the bottom margin of the body. The blades are electrically interconnected by a link disposed within the body, which link is fusible, when subjected to current exceeding a rated value, to break the interconnection. The fuse also includes a light-emitting electrical device, which lies within the bounds of the upper body profile and is positioned for ready visibility from above. The light-emitting device is so constructed and connected as to be activated, for light emission, when the link fuses as a result of being subjected to such excessive current.

The light-emitting device may be contained either within the upper portion of the body or within a supplemental component that is affixed upon the body. In the latter embodiment, the supplemental component will lie within the bounds of the upper body portion profile, the blades will have contact elements accessible thereon, and the light-emitting device will have contact elements in electrical contact with the elements of the blades. The light-emitting device will be either an incandescent lamp or at least one light-emitting diode. It will preferably comprise two light-emitting diodes connected in parallel and biased for passage of direct current in opposite directions, thereby affording dual polarity to the fault-indicating feature. The supplemental component will conveniently be adhesively secured to the fuse body.

Other objects of the invention are attained by the provision of a supplemental component per se, adapted for assembly with a blade fuse to render it fault-indicating. The supplemental component will have means for affixing it upon the upper body portion of the fuse, and will have a light-emitting electrical device contained therein and positioned for ready visibility when so attached. Contact elements of the light-emitting device will be so disposed as to establish electrical contact with contact elements of the blades of the fuse, when assembled therewith.

DETAILED DESCRIPTION OF THE ILLUSTRATED EMBODIMENTS

Figure 1:
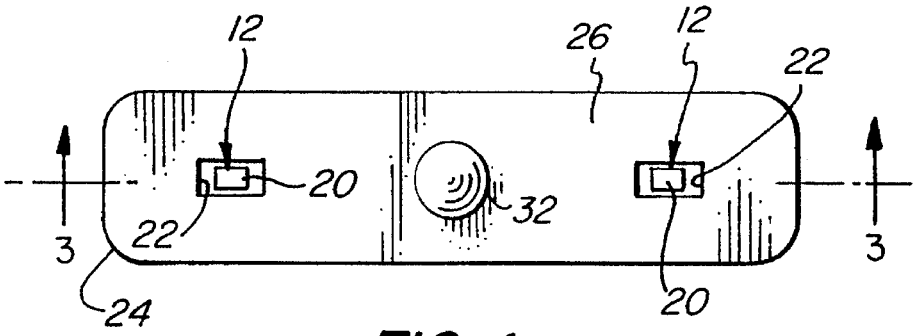
FIG. 1 of the drawings is a plan view of a fault-indicating blade fuse embodying the present invention.
Figure 3:
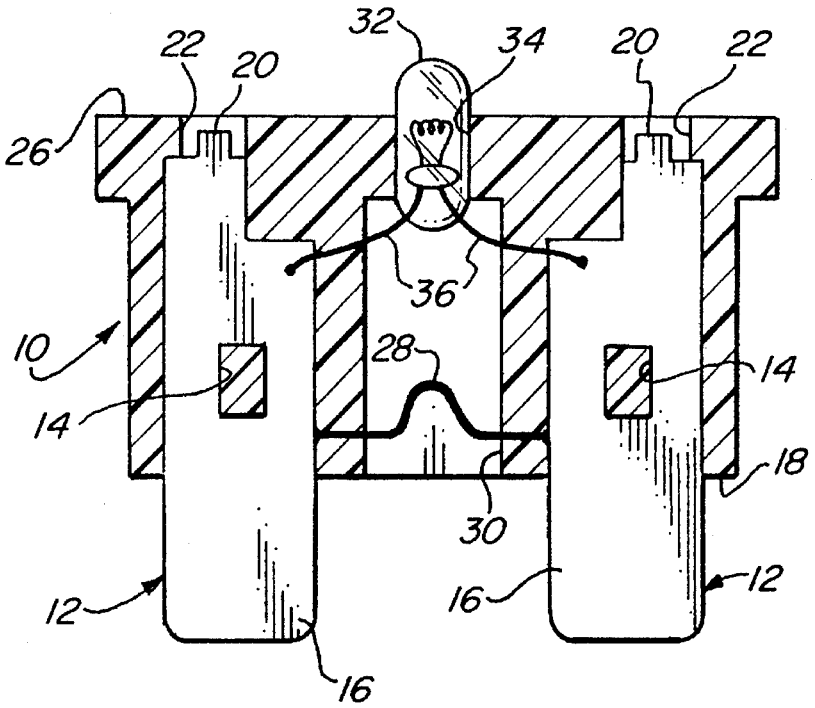
FIG. 3 is a vertical sectional view of the fuse, taken along line 3—3 of FIG. 1.
Figure 2:
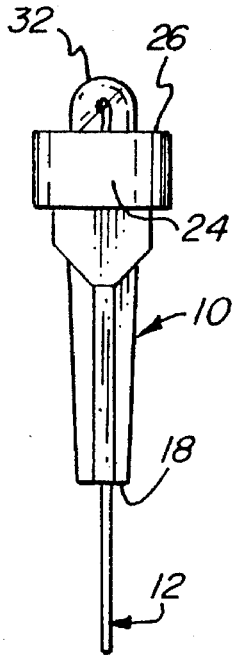
FIG. 2 is an end elevational view of the fuse depicted in FIG. 1.

Turning initially to FIGS. 1 through 3 of the drawings, therein illustrated is a blade fuse embodying the present invention and consisting of a body, generally designated by the numeral 10. The body is fabricated from a dielectric plastic material, and is molded about a pair of parallel metal blades, generally designated by the numeral 12; apertures 14 serve to enhance anchoring of the blades in the molten plastic material. A portion 16 of each blade 12 projects downwardly beyond the bottom margin 18 of the body 10, for plugging the fuse into the electrical circuit that is to be protected; an upper end portion 20 lies within a rectangular opening 22 formed through the top portion 24 of the fuse body 10, to make the blade accessible for contact from above, as for testing purposes. The fuse circuit is completed by a link element 28, which spans the body channel 30 and is connected between the blades 12. The element 28 is of course fabricated from a fusible metal, so that the connection will be broken whenever the amperage for which the fuse is rated is exceeded.

A circular aperture 43, formed through the upper portion 24 of the body in communication with the channel 30, seats a small incandescent bulb 32. Leads 36 electrically connect the bulb 32 to the blades 12. The circuitry is so designed that the bulb 32 will light when it is subjected to the full current that would otherwise pass through the fuse (i.e., when the shunt established by the fusible link 28 has been effectively removed), thus providing a visible indication of the fault.

Figure 4:
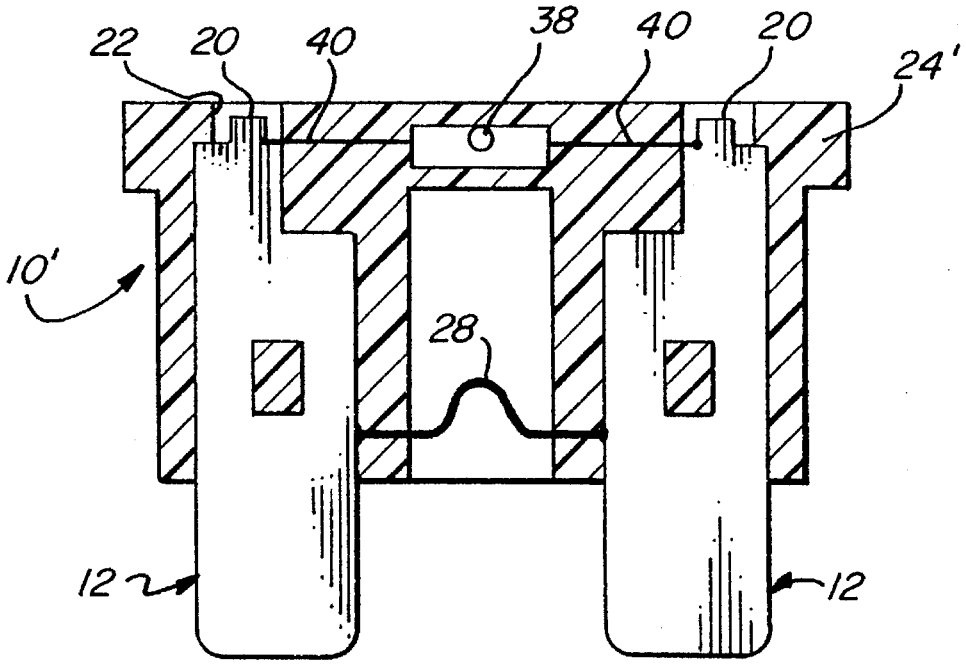
FIG. 4 is a view similar to FIG. 3, showing an alternative form of the fault-indicating fuse.

FIG. 4 illustrates a variation of the blade fuse of the invention, wherein a light-emitting diode system is substituted for the incandescent lamp 28 of the foregoing embodiment. The diode system 38 will be more fully described below with reference to FIG. 7, but it should be noted here that the illumination device, including the leads 40, is contained wholly within the upper portion 24' of the fuse body 10. Although such fabrication can be achieved in a number of ways, an effective technique is to embed the light-emitting device, after assembly with the fuse body and connection of the leads 40, in a suitable synthetic resin potting compound.

Figure 5:
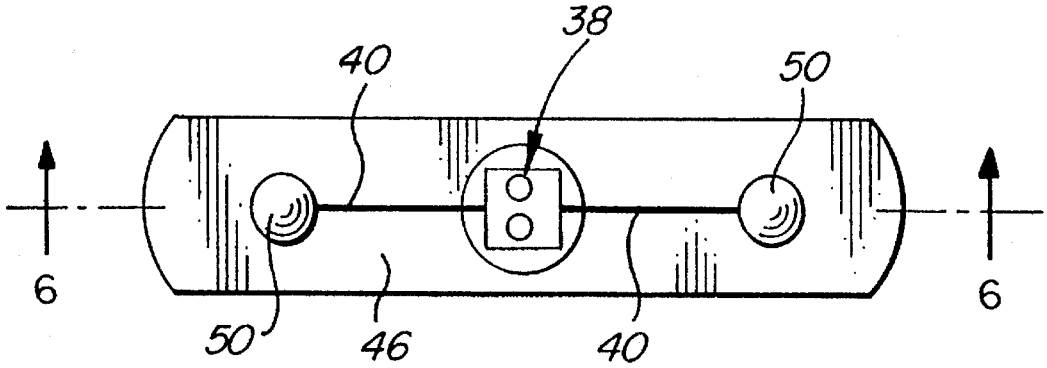
FIG. 5 is a plan view of another form of blade fuse embodying the present invention, consisting of a supplemental component assembled with a conventional blade fuse body.
Figure 6:
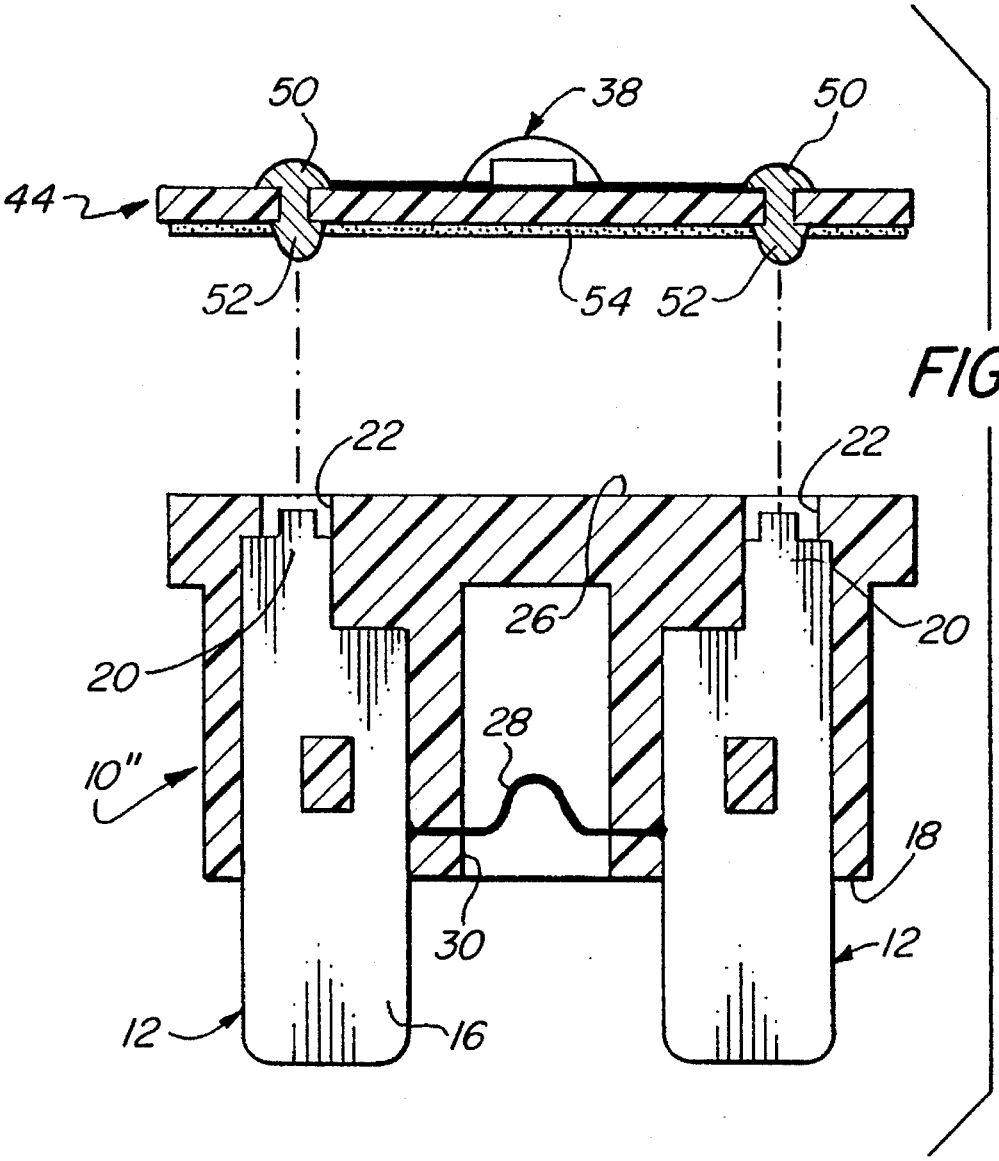
FIG. 6 is an exploded, vertical sectional view taken along line 6—6 of FIG. 5.

As another alternative, the fault-indicating fuse embodying the invention may be provided by retrofitting a supplemental component to a standard blade fuse, as depicted in FIGS. 5 and 6 of the drawings. The standard fuse shown has substantially the same features as the fuses previously described with reference to FIGS. 1 through 4, excepting only that the upper body portion 42 of the unmodified fuse body 10" has no aperture or other means for accommodating directly a light-emitting device. The supplemental unit, generally designated by the numeral 44, includes a plate 46 that is dimensioned and configured to lie within the transverse profile (i.e., the profile viewed from above) of the upper body portion 42". This is suggested in FIG. 5, from which it can be seen that the upper body portion 42" does not extend beyond the periphery of the plate 46; more importantly, however, the plate 46 does not extend beyond the periphery of the portion 42".

The plate 46 is provided with apertures 48 adjacent its opposite ends, through each of which extends a mushroom-shaped contact element 50, made of a resiliently deformable material of suitable electrical conductance, such as may be provided by a carbon-filled silicon polymer. The leads 40 from the diode assembly 38 are in electrical contact with the elements 50. The elements 50 are of sufficient length that their lower ends 52 extend into the openings 22, when the component 44 is placed upon the top surface 26 of the body 10", to thereby establish electrical contact with the upper end portions 20 of the blades 16. A strip 54 of pressure-sensitive adhesive material is provided along the lower surface of the plate 46, and serves to bond the component 44 to the upper body portion 42", when applied as described.

Despite the foregoing, it will be appreciated that other means for attaching the supplemental component can be employed, such as may take the form of a mechanical clip arrangement or the like. One advantage afforded by adhesive attachment resides however in the avoidance of need for structure that might extend beyond the profile of the fuse body, as would tend to interfere with facile insertion and removal of the fuse from the fuse block.

Figure 7:
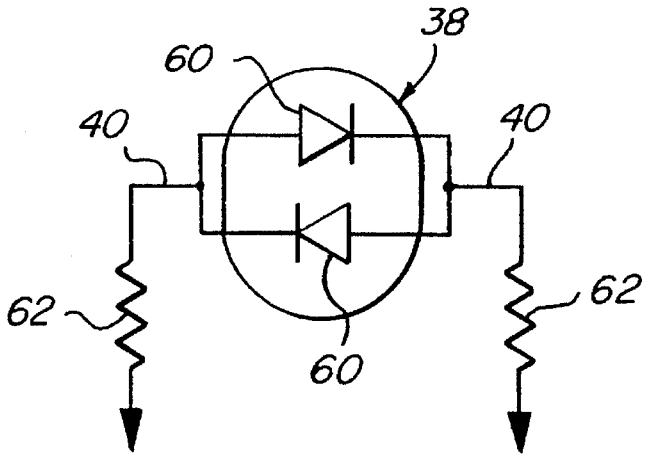
FIG. 7 is a diagrammatic representation of circuitry suitable for use in the blade fuse of the invention, utilizing a pair of light-emitting diodes as the illuminating device.

FIG. 7 depicts a light-emitting diode system suitable for integration either directly into the fuse body, or into a supplemental component for use as a retrofit unit. As can be seen, the system consists of two light-emitting diodes 60, connected in parallel and biased in opposite directions so as to enable the fault-indicating feature to function irrespective of the orientation of the installed fuse. The lines 40 from the diode leads include resistances 62, which serve to adapt the illumination device for response at a rated current value; such resistances 62 may, as a practical matter, represent the contact elements 50 depicted in FIGS. 5 and 6, the resistances of which will of course depend upon composition as well as physical parameters.

In any event, the illuminating device employed will be designed for use in a 12 or 24 volt D.C. system, normally to draw a current of 0.002 to 0.06 ampere. Neon bulbs, for example, will not be suitable.

Thus, it can be seen that the present invention provides a novel blade fuse having an integrated fault-indicating feature, which shows that a fault has occurred by illumination of a light-emitting electrical device. The invention also provides a supplemental component that is adapted for assembly with a conventional blade fuse to render it fault-indicating. Although their intended purpose is as herein described, it will be appreciated that the fuse and the supplemental component of the invention may be employed as trouble-shooting tools, if so desired.

Having thus described the invention, what is claimed is:

1. A fault-indicating blade fuse comprising a relatively thin and flat, generally rectangular, dielectric body defined by top, bottom and opposite side margins, and having an upper portion of long, narrow profile, taken in transverse cross section; a pair of generally parallel metal blades projecting downwardly beyond said bottom margin of said body; a link within said body electrically interconnecting said blades and being fusible to break the interconnection when subjected to current exceeding a rated value; and a light-emitting electrical device positioned for ready visibility from above said fuse and lying within the bounds of said upper body profile, said light-emitting device being so constructed and so connected to said blades as to be activated, for light emission, upon fusion of said link when subjected to such excessive current.

2. The fuse of claim 1 wherein said light-emitting device is selected from the group consisting of incandescent lamps and at least one light-emitting diode.

3. The fuse of claim 2 wherein said light-emitting device comprises first and second light-emitting diodes connected in parallel and biased for passage of direct current between . said blades in opposite directions, said diodes thereby affording dual polarity to the fault-indicating feature of said fuse.

4. The fuse of claim 1 wherein said light-emitting device is contained within said upper portion of said body.

5. The fuse of claim 1 further including a supplemental component affixed upon said upper portion of said body, said blades having contact elements on said upper body portion, and said light-emitting device being contained within said supplemental component and having contact elements in electrical contact with said contact elements of said blades.

6. The fuse of claim 5 wherein said supplemental component is adhesively secured to said body.

7. The fuse of claim 5 wherein said supplemental component lies within the bounds of said upper body profile.

8. A supplemental component for assembly with a blade fuse to render it fault-indicating, the blades of the fuse having contact elements accessible on an upper portion of the fuse body and being electrically interconnected by a link that is fusible to break the interconnection when subjected to current exceeding a rated value; said supplemental component having means for affixing it upon the upper body portion of the fuse, and having a light-emitting electrical device contained therein and positioned for ready visibility when said supplemental component is attached to the fuse by said means for affixing, said light-emitting device having contact elements disposed to establish electrical contact with the contact elements of the fuse blades when said supplemental component is so attached.

9. The component of claim 8 wherein said light-emitting device is selected from the group consisting of incandescent lamps and at least one light-emitting diode.

10. The component of claim 9 wherein said light-emitting device comprises first and second light-emitting diodes connected in parallel and biased for passage of direct current between said blades in opposite directions, said diodes thereby affording dual polarity to the fault-indicating feature of said fuse.

11. The component of claim 8 wherein said means for securing comprises an adhesive element disposed for adhesively securing said component to the upper body portion of the fuse with said light-emitting device so positioned.

12. A fault-indicating blade fuse comprising a relatively thin and flat, generally rectangular, dielectric body defined by top, bottom and opposite side margins, and having an upper portion of long, narrow profile, taken in transverse cross section; a pair of generally parallel metal blades projecting downwardly beyond said bottom margin of said body; a link within said body electrically interconnecting said blades and being fusible to break the interconnection when subjected to current exceeding a rated value; and at least one light-emitting diode positioned for ready visibility from above said fuse and lying within the bounds of said upper body profile, said at least one light-emitting diode being so constructed and so connected to said blades as to be activated, for light emission, upon fusion of said link when subjected to such excessive current, the connection between said at least one light-emitting diode and said blades including a line having a resistance element therein.

13. The fuse of claim 12 comprising first and second light-emitting diodes connected in parallel and biased for passage of direct current between said blades in opposite directions, said diodes thereby affording dual polarity to the fault-indicating feature of said fuse, the connections between each of said light-emitting diodes and said blades including a line having a resistance element therein.

14. The fuse of claim 12 wherein said light-emitting diode is contained within said upper portion of said body.

15. The fuse of claim 12 further including a supplemental component affixed upon said upper portion of said body, said blades having contact elements on said upper body portion, and said light-emitting diode being contained within said supplemental component and having contact elements in electrical contact with said contact elements of said blades.

16. The fuse of claim 15 wherein at least one of said contact elements comprises said resistance element.

17. The fuse of claim 15 wherein said supplemental component lies within the bounds of said upper body profile.

* * * * *

US005598138C1

(12) EX PARTE REEXAMINATION CERTIFICATE (8726th)

United States Patent
Jaronczyk, Jr.

(10) Number: US 5,598,138 C1
(45) Certificate Issued: Dec. 6, 2011

(54) FAULT-INDICATING BLADE FUSE

(75) Inventor: Joseph P. Jaronczyk, Jr., Windsor, CT (US)

(73) Assignee: Fusilamp, LLC, Miami, FL (US)

Reexamination Request:
No. 90/010,844, Mar. 17, 2010

Reexamination Certificate for:

| | |
|---|---|
| Patent No.: | **5,598,138** |
| Issued: | **Jan. 28, 1997** |
| Appl. No.: | **08/368,303** |
| Filed: | **Jan. 3, 1995** |

(51) Int. Cl.
*H01H 85/30* (2006.01)

(52) U.S. Cl. ..... 337/265; 337/198
(58) Field of Classification Search ..... 337/265
See application file for complete search history.

(56) References Cited

To view the complete listing of prior art documents cited during the proceeding for Reexamination Control Number 90/010,844, please refer to the USPTO's public Patent Application Information Retrieval (PAIR) system under the Display References tab.

*Primary Examiner*—My-Trang Nu Ton

(57) ABSTRACT

A fault-indicating blade fuse includes a light-emitting electrical device that is positioned for ready visibility from above the fuse. The device lies within the bounds of the upper body profile of the fuse, and is so constructed and connected as to be activated upon fusion of the link, when the fuse is subjected to excessive current. In one form, a supplemental component contains a light-emitting electrical device and includes means for affixing it to the upper body portion of a fuse. Contact elements on the supplemental component establish electrical contact with the blades of the assembled fuse.

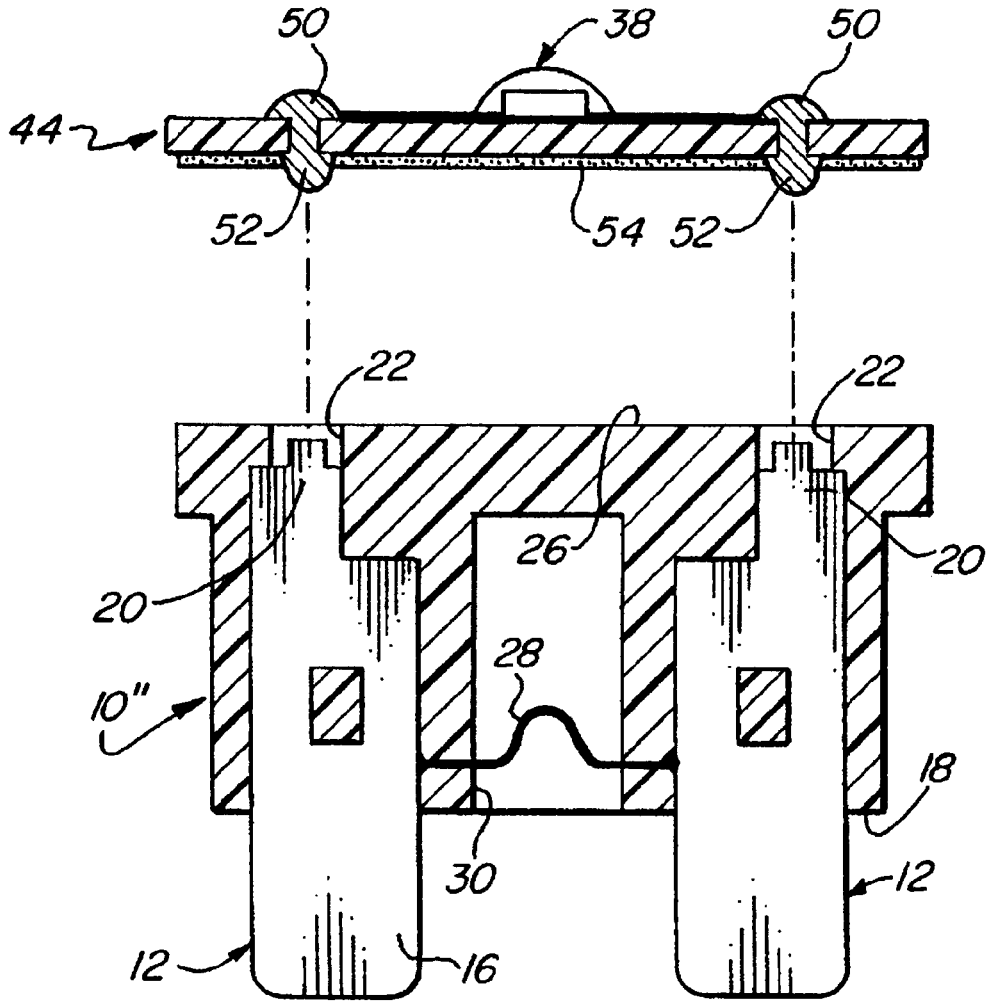

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8-10 is confirmed.

Claim 5 is cancelled.

Claims 1, 6, 7, 11 and 12 are determined to be patentable as amended.

Claims 2, 3, 4 and 13-17, dependent on an amended claim, are determined to be patentable as amended.

New claim 18 is added and determined to be patentable.

1. A fault-indicating blade fuse comprising a relatively thin and flat, generally rectangular, dielectric body defined by top, bottom and opposite side margins, and having an upper portion of long, narrow profile, taken in transverse cross section; a pair of generally parallel metal blades projecting downwardly beyond said bottom margin of said body; a link within said body electrically interconnecting said blades and being fusible to break the interconnection when subjected to current exceeding a rated value; a light-emitting electrical device positioned for ready visibility above said fuse and lying within the bounds of said upper body profile, said light-emitting device being so constructed and so connected to said blades as to be activated, for light emission, upon fusion of said link when subjected to such excessive current*; a pair of rectangular openings, each in an upper end portion of the dielectric fuse body within an opening formed through the top portion of the dielectric fuse body; and*

*a supplemental component affixed upon said upper portion of said body, said blades having contact elements on said upper body portion, and said light-emitting device being contained within said supplemental component and having contact elements in electrical contact with said contact elements of said blades.*

6. The fuse of claim [5] *1* wherein said supplemental component is adhesively secured to said body.

7. The fuse of claim [5] *1* wherein said supplemental component lies within the bounds of said upper body profile.

11. The component of claim [8] *9* wherein said means for securing comprises an adhesive element disposed for adhesively securing said component to the upper body portion of the fuse with said light-emitting device so positioned.

12 . A fault-indicating blade fuse comprising a relatively thin and flat, generally rectangular, dielectric body defined by top, bottom and opposite side margins, and having an upper portion of long, narrow profile, taken in transverse cross section; a pair of generally metal blades projecting downwardly beyond said bottom margin of said body; a link within said body electrically interconnecting said blades and being fusible to break the interconnection when subjected to current exceeding a rated value; at least one light-emitting diode positioned for ready visibility from above said fuse and lying within the bounds of said upper body profile, said at least one light-emitting diode being so constructed and so connected to said blade as to be activated, for light emission, upon fusion of said link when subjected to such excessive current, the connection between said at least one light-emitting diode and said blades including a line having a resistance element therein*; and*

*means for connecting the blade fuse to a supplemental component comprising a light-emitting diode.*

*18. The fuse of claim 1 wherein the openings comprise a length that is sufficient to establish electric contact between upper end portion of the blades and conductive elements of an adhesively attachable supplemental component having a light emitting electrical device adhesively attachable to the blade fuse.*

* * * * *

US005598138C2

(12) EX PARTE REEXAMINATION CERTIFICATE (10691st)

United States Patent
Jaronczyk

(10) Number: US 5,598,138 C2
(45) Certificate Issued: Aug. 25, 2015

(54) FAULT-INDICATING BLADE FUSE

(75) Inventor: Joseph P. Jaronczyk, Windsor, CT (US)

(73) Assignee: FUSILAMP, LLC, Miami, FL (US)

Reexamination Request:
No. 90/013,078, Dec. 5, 2013

Reexamination Certificate for:

| | |
|---|---|
| Patent No.: | **5,598,138** |
| Issued: | **Jan. 28, 1997** |
| Appl. No.: | **08/368,303** |
| Filed: | **Jan. 3, 1995** |

Reexamination Certificate C1 5,598,138 issued Dec. 6, 2011

(51) Int. Cl.

| | |
|---|---|
| ***H01H 85/32*** | (2006.01) |
| ***H01H 85/00*** | (2006.01) |
| ***H01H 85/041*** | (2006.01) |

(52) U.S. Cl.
CPC ..... *H01H 85/0417* (2013.01); *H01H 85/32* (2013.01)

(58) Field of Classification Search
None
See application file for complete search history.

(56) References Cited

To view the complete listing of prior art documents cited during the proceeding for Reexamination Control Number 90/013,078, please refer to the USPTO's public Patent Application Information Retrieval (PAIR) system under the Display References tab.

*Primary Examiner* — Adam L Basehoar

(57) ABSTRACT

A fault-indicating blade fuse includes a light-emitting electrical device that is positioned for ready visibility from above the fuse. The device lies within the bounds of the upper body profile of the fuse, and is so constructed and connected as to be activated upon fusion of the link, when the fuse is subjected to excessive current. In one form, a supplemental component contains a light-emitting electrical device and includes means for affixing it to the upper body portion of a fuse. Contact elements on the supplemental component establish electrical contact with the blades of the assembled fuse.

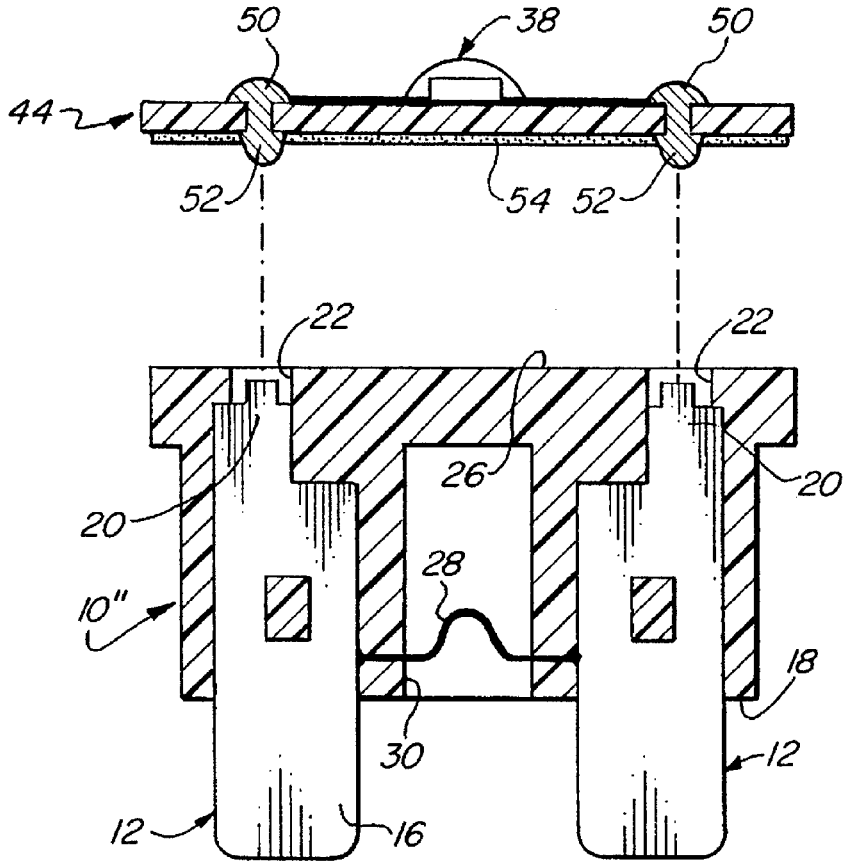

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

The patentability of claims 7, 14 and 17 is confirmed.

Claim 5 was previously cancelled.

Claims 1-4, 6, 8-13, 15, 16 and 18 are cancelled.

* * * * *